United States Patent [19]

Bauer et al.

[11] 4,325,235

[45] Apr. 20, 1982

[54] WASHING APPARATUS

[75] Inventors: Peter Bauer, Germantown; Julian Lazrus, Bethesda, both of Md.

[73] Assignee: Bowles Fluidics Corporation, Silver Spring, Md.

[21] Appl. No.: 136,860

[22] Filed: Apr. 3, 1980

Related U.S. Application Data

[62] Division of Ser. No. 576,713, May 12, 1975, Pat. No. 4,227,550, which is a division of Ser. No. 356,416, May 2, 1973, abandoned.

[51] Int. Cl.[3] ..... D06F 7/00; D06F 39/06

[52] U.S. Cl. ..... 68/3 SS; 68/181 R; 68/207

[58] Field of Search ..... 68/3 SS, 181 R, 181 D, 68/184, 207, 237, 235 R, 235 D, 232, 233, 208, 23.5; 134/184, 198; 137/806, 826, 835, 836, 815

[56] References Cited

U.S. PATENT DOCUMENTS

| | | | |
|---|---|---|---|
| 2,303,940 | 12/1942 | Kuhn | 68/208 X |
| 2,455,523 | 12/1948 | Rodack | 366/166 |
| 2,694,555 | 11/1954 | Sinkwich | 68/181 R X |
| 2,907,052 | 10/1959 | Louis et al. | 68/232 X |
| 3,185,166 | 5/1965 | Horton et al. | 137/835 |
| 3,207,481 | 9/1965 | Ranson | 134/198 X |
| 3,444,710 | 5/1969 | Gaugler et al. | 68/3 SS X |
| 3,563,462 | 2/1971 | Bauer | 137/835 X |
| 3,620,050 | 11/1971 | Glasgow | 68/3 SS |
| 3,670,754 | 6/1972 | Freeman | 137/806 X |

FOREIGN PATENT DOCUMENTS

| | | | |
|---|---|---|---|
| 735850 | 8/1955 | United Kingdom | 68/207 |

*Primary Examiner*—Philip R. Coe

*Attorney, Agent, or Firm*—Howard L. Rose

[57] ABSTRACT

In a clothes washer, liquid pulses are delivered to a bucket or tank of water to create continuously re-circulating flow therein in a vertical plane. Air is introduced into the water pulses and forms air bubbles in the tank which attract dirt particles and carry them to the surface where they are removed as part of a continuous surface overflow. In a preferred embodiment the liquid pulses are delivered by a novel fluidic oscillator of the feedback type in which air is continuously entrained by the power stream from each feedback passage in alternation. In one form, the oscillator utilizes scoop-type feedback passages between respective outlet passages and control ports, each feedback passage communicating with an air passage. In a second form of oscillator the feedback passages are of the suction type which are aspirated by the liquid outflow through respective oscillator outlet passages.

26 Claims, 9 Drawing Figures

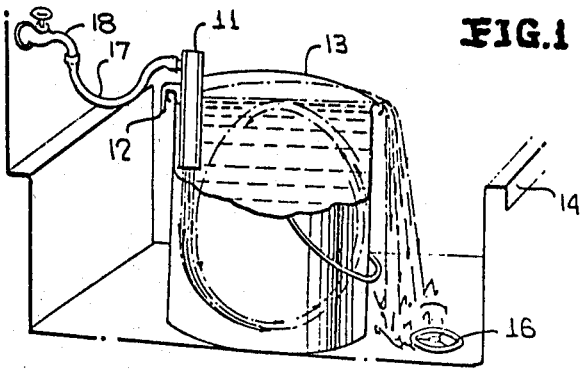
FIG.1
FIG.2
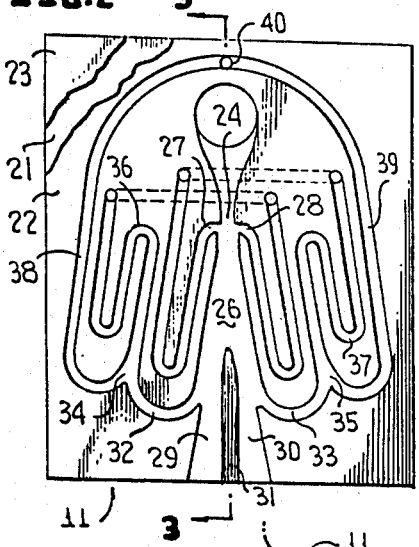
FIG.3
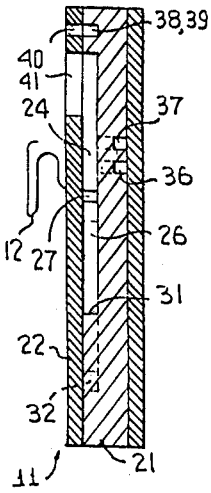
FIG.4
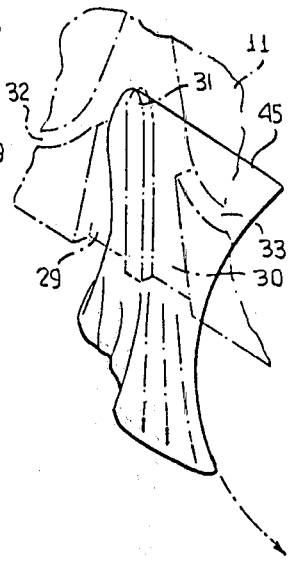
FIG.5
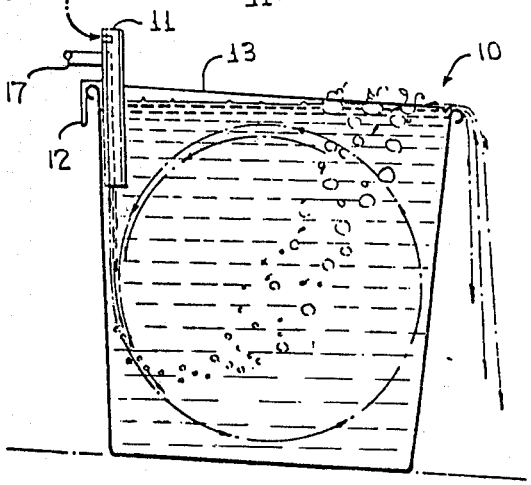

WASHING APPARATUS

This is a division of application Ser. No. 576,713, filed May 12, 1975, now U.S. Pat. No. 4,227,550, which was in turn a division of application Ser. No. 356,416, filed May 2, 1973, now abandoned.

BACKGROUND OF THE INVENTION

The present invention relates to an improved portable apparatus for washing clothes and similar items and to novel fluidic oscillators particularly suited for use in that apparatus.

Commerically available clothes washing machines generally employ either an agitation or tumbling action to effect cleaning. Agitation is generally performed by rotating blades or vanes which produce turbulent convection of water and/or detergent through the material to be cleaned. Tumbling is generally effected by a rotating drum which constantly tumbles the material through a water solution. In both cases the operating mechanism requires: electrical energy to drive the machine; and a mechanism with moving parts which are subject to wear and eventual failure. Moreover, mechanisms of this type are both relatively expensive and sufficiently massive to preclude portability. Portability is important to permit utilization by travellers who have limited access to permanently installed washing machines and by apartment dwellers and the like whose residences are subect to restrictions which prevent installation of conventional washing machines.

Another problem inherent in conventional washing machines resides in the fact that they are designed to wash multiple-item loads, thereby rendering them inefficient for cleaning one or two small items. Thus, the tendency is to collect soiled clothes until a load of sufficient volume is gathered to permit efficient use of a conventional washing machine. This severely limits the availability of garments.

Still another cleansing action which is effective with clothes is microflotation. In this cleansing action air bubbles are intermixed with the water and/or detergent and are permitted to rise to the surface. In so doing they attract dirt particles in the water solution and from the clothes so that the dirt is also floated to the surface where it can be readily removed. Microflotation is not feasible in most commercial washing machines because the water solution is continuously re-cycled through the washing tank. As such, any dirt floated to the surface could not be removed but instead is recirculated back into the wash solution.

It is therefore an object of the present invention to provide apparatus for washing clothes and the like which utilizes agitation, tumbling and microflotation, all in combination, yet which does not employ moving parts and does not require electricity for operation.

It is another object of the present invention to provide an apparatus for washing clothes and the like which is relatively inexpensive and portable.

It is still another object of the present invention to provide a clothes washing apparatus which can be utilized anywhere where a source of water under pressure is available and which is efficient for washing even a single garment.

Attempts have been made in the past to eliminate the need for moving parts in clothes washing machines. For example, U.S. Pat. No. 3,358,478 to Heskestad describes utilization of a fluidic amplifier which delivers a pair of alternately pulsating jets radially into a wash tank to effect agitation of the wash solution. The fluidic amplifier eliminates the need for rotating blades to effect agitation but nevertheless requires an electrically-operated pump for the purpose of recirculating the wash solution. Moreover, the Heskestad approach provides only agitation to effect cleansing; there is no tumbling or microflotation action to increase the efficiency of dirt removal.

Another prior art washing machine employing a fluidic amplifier to deliver water pulses to a wash tank is disclosed in U.S. Pat. No. 3,444,710 to Gaugler et al. This approach requires that the pulses be delivered substantially tangential to the tank wall and into a load basket which rotates about a vertical axis. This approach also effects agitation; however, efficient cleaning is made possible only by rotating the basket, which requires an electrically operated motor. Further, the basket rotation is opposite to jet flow and counteracts any tendency of the pulsed liquid jets to force the clothes to flow through the water; therefore, no tumbling of the cothes, as such, occurs. Still further, microflotation is not suggested by Gaugler et al.

Although not useful as a clothes washer, another fluidic washing machine is disclosed in U.S. Pat. No. 3,620,050 to Glasgow. That patent describes apparatus suitable for cleaning solid objects and comprises a basin having sidewalls which are sharply inclined and converge down toward the cleaning region. Liquid pulses from one or more fluidic oscillators are directed substantially radially toward the center of the cleaning region where an object to be cleaned remains throughout the cleaning operation. An overflow outlet permits continuous draining of the liquid from the basin. Cleaning is effected by agitation of the bath liquid by means of the high frequency liquid pulses delivered from the fluidic oscillators; the action is analogous to the cleaning effect produced by ultrasonic baths. Moreover, Glasgow describes a reaction by air bubbles on the dirt, implying a microflotation effect. As described above, Glasgow's apparatus is not suited for washing clothes. Specifically, cleaning in Glasgow's apparatus is effective only if the object being cleaned remains stationary at the bottom of the funnel-like basin. Moreover, the basin is structured to inhibit any tumbling-type movement of clothes. Further, although Glasgow suggests that air bubbles can be drawn into the pulsating streams, there is no suggestion in the patent as to how this may be accomplished; in this regard, the oscillators illustrated in Glasgow's drawings are not provided with any means which will permit the pulsating streams to draw ambient air into the streams. Consequently, while Glasgow has apparently recognized the advantage of microflotation in a washing apparatus, the Glasgow patent does not disclose how this is to be effected.

It is therefore another object of the present invention to provide a clothes washing apparatus in which a fluidic oscillator effects both agitation and tumbling of the load and readily introduces air bubbles into the cleaning tank to effect microflotation.

It is still another object of the present invention to provide a fluidic oscillator capable of delivering liquid pulses and which efficiently causes entrainment of relatively large amounts of ambient air by these pulses prior to delivery.

SUMMARY OF THE INVENTION

According to one aspect of the present invention a clothes washer features a fluidic oscillator or other liquid pulse source which is arranged to deliver pulses of liquid along a wall, preferably down along a vertical wall, of an open-topped container such as a conventional laundry bucket. The pulsing liquid creates a rotational flow path in a vertical plane (i.e.—about a horizontal axis) which acts to carry the wash load in a tumbling type of cleaning action. In addition, as the items in the tumbling load pass by the pulsating liquid delivered by the oscillator, the items are directly agitated by the pulses to effectively shake loose any dirt adhering to the fabric. Further, the oscillator is expressly provided with means for entraining air into the liquid pulses, which air is manifested as bubbles in the container, the bubbles acting to attract and carry dirt from the load to the surface. The liquid is permitted to continuously drain over the sides of the open container, thereby quickly removing the dirt carried to the surface by the air bubbles.

The oscillator may be adapted for use with a conventional laundry bucket which can be placed in a bath, laundry, or other tub having a drain to accommodate the bucket overflow. Alternatively a collapsible bucket having a suitable drain hose may be specially provided. In either case, the sole power source is the water pressure supplied at a standard spigot, and the unit is both inexpensive and portable.

According to another aspect of the present invention a fluidic oscillator is provided which has particular utility with the aforesaid clothes washing apparatus in that it efficiently introduces air into the pulsating liquid. In one embodiment the oscillator includes left and right outlets, left and right control ports, and scoop-type cross-over feedback passages extending between the left outlet and right control port and between the right outlet and left control port. Respective air passages communicate with each feedback passage. When liquid flows through the right outlet, a portion is scooped by the corresponding feedback path and aspirated by the power stream to the left control port with relatively little air content. With no scooped liquid in the other feedback passage a relatively large volume of air is aspirated by the power stream to the right control port. Since air as a flow medium provides lesser flow impedance than water, a greater volumetric flow rate is aspirated to the right control port than to the left, and the power stream is caused to switch to the left outlet. Switching between each outlet proceeds in this manner with air being continually drawn into the power stream from one feedback passage and then the other.

In an alternative oscillator embodiment the oscillator interaction region is in the form of a flow-reversing chamber, thereby avoiding the need to cross the feedback passages over from the left to right sides of the oscillator. In another oscillator embodiment the feedback passages are of the aspiration type rather than the scoop type, whereby flow through either outlet passage aspirates liquid from the corresponding feedback passage. Each feedback passage includes a respective air passage extending to above the surface of the body of liquid into which the oscillator is inserted. The liquid level in the air passage for the inactive outlet (i.e.—carrying no outflow) rises to the liquid level in the tank. The liquid level in the other air passage is lowered substantially by the aspiration action of the outflow from that outlet. The feedback path connection to the control ports is from the air passage at a level between the alternating liquid levels. Thus, air is aspirated through one control port and water through the other. The oscillator can therefore be made to switch states according to the flow state in the corresponding outlets.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein:

FIG. 1 is a view in perspective illustrating a clothes washing apparatus according to the present invention;

FIG. 2 is a plan view of a fluidic oscillator according to the present invention;

FIG. 3 is a view in section along the lines 3–3 of FIG. 2;

FIG. 4 is a partially diagrammatic view in perspective of the agitation action provided by the apparatus of FIG. 1;

FIG. 5 is a plan view illustrating the microflotation effect produced by the apparatus of FIG. 1;

DESCRIPTION OF PREFERRED EMBODIMENTS

Figure 6:
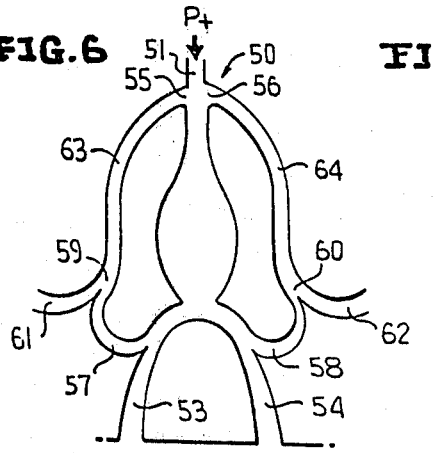
FIG. 6 is a plan view of an alternative oscillator embodiment according to the present invention.

Referring specifically to FIG. 1 of the accompanying drawings, a washer apparatus according to the present invention is designated by the numeral 10. The apparatus includes a fluidic oscillator 11, or other source of liquid pulses, mounted by means of a bracket 12 on the rim of a conventional laundry bucket 13. When so mounted the outlet end of oscillator 11 projects down into the bucket and outflow from the oscillator is directed downward, generally along the bucket wall. The bucket is located upright in a tub 14 having a suitable drain opening 16. A hose 17 directs pressurized supply liquid to oscillator 11 from a spigot 18 associated with the tub.

When bucket 13 has filled with water supplied from oscillator 11, the pulsating oscillator outflow creates a circulating flow pattern in the bucket as indicated by the arrows in FIG. 1. Specifically, the circulating flow pattern is substantially in vertical plane (i.e.—about a horizontal axis normal to the plane of the drawing) and defines a flow path which is followed by garments placed in the bucket. The garments are thus tumbled as they circulate with the flow. A garment located on the surface of the bucket 14 is carried by the circulating flow toward the oscillator 11 and then forcibly drawn below the surface by the aspirating action of the oscillator outflow. The garments are thus quickly wetted rather than remaining on the surface for any significant period of time as is the case with conventional agitation-type washing apparatus. Each time the garment is forcibly drawn down by the oscillator outflow it is agitated by the outflow pulses in a manner described in detail in relation to FIG. 4. The garment is thus tumbled and agitated by the washer apparatus of FIG. 1 which thereby efficiently dis-lodges dirt from the garment.

In operation, a pelletized detergent, such as Salvo, may be placed in tube 14 along with the garments and is carried by the tumbling flow path as it slowly disolves in the water.

Alternatively, detergent may be admitted into the liquid along with the liquid pulses delivered by the oscillator, or an apertured container may be inserted into or secured to the bucket to permit slow release of contained detergent as the wash liquid circulates. In some instances it will not be necessary to utilize any detergent, reliance being placed on the efficient cleansing action provided by both the tumbling and agitation of the garments. Further, as described below, the pulsating liquid from oscillator 11 carries air bubbles into the bucket. These bubbles, while rising to the surface, attract dirt particles which are carried by the bubbles to the surface. Dirt particles at the surface are removed as part of the continuous overflow over the bucket rim. The apparatus of FIG. 1, therefore, does not re-circulate dirty wash water but instead continuously drains the dirty water and replenishes the wash solution with fresh water from spigot 18 via oscillator 11. Thus, the apparatus in FIG. 1 not only provides a double cleansing action (i.e.—tumbling and agitation), but also employs microflotation and continuous surface overflow to immediately remove loosened dirt particles and preven recirculation of dirt.

A particularly appropriate oscillator 11 for use in washer apparatus 10 is illustrated in FIGS. 2 and 3. Oscillator 11 comprises front and rear plates 23 and 22, respectively, and an intermediate plate 21 in which the various oscillator channels and passages are formed. The number of plates and the manner in which the elements of the oscillator are formed are not critical and can be varied considerably within the scope of the present invention. Moreover, to facilitate visualization and understanding, the plates are shown as transparent plastic in FIG. 2, although this is not a limiting feature of the present invention. Oscillator 11 is shown with its outlets directed downward in FIGS. 2 and 3, that being its orientation when employed as described in relation to FIG. 1.

The larger portion of oscillator 11 is defined by coplanar channels formed in the rear surface of intermediate plate 21. These channels include a power nozzle 24, an interaction region 26, left and right control ports 27 and 28, respectively, and left and right outlet passages 29 and 30, respectively, which are separated by a flow divider 31. Interaction region 26 is defined between sidewalls which are each configured to effect boundary layer attachment of the power stream issued from power nozzle 24; the fluidic element as thus far described is therefore what is known as a bistable element since outflow can stably subsist through either outlet passage 29 and 30.

Left and right scoop passages 32 and 33 are also defined in the rear surface of intermediate plate 21 and are arranged to scoop a portion of the flow through left and right outlet passages 29 and 30, respectively. These scoop passages are relatively short and terminate at respective three-passage junctions 34 and 35. These junctions may be T-configured or Y-configured and serve as the inlet end for respective feedback passages 36 and 37. Feedback passage 36 extends from junction 34, where it is oriented to receive liquid flow from left scoop passage 32, to the right control port 28. In so extending, feedback passage 36 includes a section which passes through plate 21 to a channel which is defined in the front surface of that plate and crosses over to the right side of the element where it joins with another section extending through plate 21 to a channel defined in the rear surface of that plate. Likewise, feedback passage 37 extends from junction 35, where it is oriented to receive liquid flow from right scoop passage 33, to left control port 27. In so extending, feedback passage 37 also extends through intermediate plate 21, then along a cross-over section at the front surface of that plate, and then back through the plate to the left control port 27. Both feedback passages are shown as long, tortuous passages, the length serving to increase the feedback time and thereby lower the oscillator operating frequency.

Also meeting at junction 34 is an air passage 38 which extend to a location proximate the uppermost end of the oscillator at which point it communicates with an aperture 40 defined through rear plate 22. A similar air passage 39 communicates between junction 35 and aperture 40. If desired, passages 38 and 39 may communicate with separate apertures. Air passages 38 and 39 are oriented so as not to receive direct liquid flow from respective scoop passages 32 and 33 but to direct flow into respective feedback passages 36 and 37.

When operating in the washer apparatus of FIG. 1, oscillator 11 has its lower end projecting below the rim of bucket 13 so that at least a portion of each outlet passage 29 and 30 is submerged below the surface of the circulating wash liquid. The depth to which the oscillator is submerged is not critical, other than the fact that aperture 40 must either be above the liquid surface or be provided with a tube connection to permit free flow of ambient air into air passages 38 and 39.

Assume for purposes of explanation that the water level in bucket 13 is somewhere between the lower end of outlet passages 29, 30 and scoop passages 32 and 33 so that water level does not cause residual water to enter the scoop passages. Pressurized water is delivered to power nozzle 24 through aperture 40 in rear plate 22, by such means as hose 17 and a suitable hose fitting arrangement (not shown). The power nozzle defines a liquid power stream which is issued into interaction region 26. Due to random perturbations in the power stream it deflects towards and attaches to one or the other sidewalls of interaction region 26 and issues out through the corresponding outlet passage. Assuming that initial deflection is to the left, outflow is through left outlet passage 29 and a portion of this outflow is scooped by left scoop passage 32 and directed across junction 34 into feedback passage 36. The flow of the power stream past control ports 27 and 28 creates low pressure regions at these ports which act to aspirate fluid fromthe feedback passages. This aspiration causes the scooped liquid to flow through feedback passage 36 to right control port 28. At the same time, the aspiration effect produced at left control port 27 draws air to that port from aperture 40 through air passage 39 and across junction 35. Since air, as a flow medium, presents less flow impedance than water, the flow rate of air to left control port 27 is greater than the flow rate of water to right control port 28. This results in a greater pressure on the left side of the power stream than on the right side, causing the stream to deflect toward and attach to the right sidewall of the interaction region. Adding to the effect of the different aspirated flow rates is the fact that water is more viscous than air. This fact causes a shearing effect at right control port 28 where the water flowing through the control port attracts and tends to pull the power stream toward the right side. The overall effect is a switching of the power stream to right outlet passage 30.

When the power stream is directed to right outlet passage 30, a portion of the stream is scooped by right scoop passage 33 and is caused to flow through feedback passage 37 to left control port 27 by the aspiration action of the power stream in flowing past that port. Likewise, aspiration at right control port 28 now draws air from air passage 38 through feedback passage 36 and the power stream is deflected back to its original state wherein it flows through left outlet passage 29. Oscillatory deflection of the power stream continues in this manner, resulting in issuance of discrete liquid pulses alternately from outlet passages 29 and 30.

If the oscillator is submerged somewhat deeper into bucket 13, such that the standing water level is above junctions 34 and 35, a similar operation ensues. In this case water flows in both the active and inactive feedback passages 36 and 37; but the water flow in the inactive feedback passage is caused solely by aspiration at the passage-terminating control port whereas water flow in the active feedback passage is additionally forced by the scooped portion of the oscillator outflow. Thus, in the inactive feedback path, a relatively large flow of air from the air passage (38 or 39) is entrained into the water flow in the form of air bubbles; this increases the pressure at the passage-terminating control port. The water flow in the active feedback passage, on the other hand, contains substantially more water and less air than in the inactive feedback passage and produces a relatively low pressure at the terminating control port of the active feedback passage. The pressure differential at the control ports effects switching of the power stream which occurs cyclically at a rate determined by the feedback passage lengths. An additional factor which aids switching is the fact that the strength of aspiration at the control ports changes cyclically because the switching power stream is alternately close to and far from each control port. The feedback passage with the highest air content (i.e.—the inactive feedback passage) is therefore always aspirated to a somewhat greater extent than the active feedback passage and the switching action is thereby enhanced.

From the foregoing it is apparent that oscillator 11 can be submerged to any depth into bucket 13, as long as some provision is made to permit free entry of ambient air into air passages 38 and 39. In this regard it would be possible to position oscillator 11 to issue its pulses along the bottom wall of bucket 13 and run an air tube to supply ambient air to the oscillator air passages. This bottom wall position of the oscillator would still create a tumbling flow action and would still permit the pulsing liquid to agitate the clothes flowing past the oscillator. The oscillator will also provide these effects if it is oriented to direct its outflow upwardly along the bucket sidewall. Nevertheless, I have found it more desirable to orient the oscillator as illustrated in FIG. 1; namely, to issue its outflow downwardly along the bucket sidewall.

The agitation effect produced on the clothes by the oscillator outflow pulses is best illustrated in FIG. 4. Specifically, an article of clothing 45 is shown being pulled downward by a water pulse issued from right outlet passage 30. The portion of article 45 being so pulled is drawn taut while the adjacent portion of the article is relaxed. Upon issuance of the next pulse from left outlet 29, the formerly relaxed portion of the article is drawn taut while the formerly taut portion is relaxed. Portions of article 45 are thus rendered alternately taut and relaxed as they pass the oscillator, providing an overall agitation effect which is very efficient in dislodging dirt from the article. The agitation, however, is produced without moving mechanical parts which might tend to snag the article and possible damage it.

The air inflow to the inactive feedback passage of the oscillator not only effects switching, but also provides a means of introducing air into the water outflow from the oscillator. Specifically, air is continually entrained from the inactive feedback passage by the water power stream. The air so entrained takes the form of air bubbles when issued into the water filled bucket 13. These bubbles, as illustrated in FIG. 5, are initially forced downward by the flow momentum of liquid pulses in which they are contained. The bubbles then begin to scatter and rise to the surface. In so doing the bubbles attract dirt particles which have been loosened from the wash load and carry the particles to the surface. The dirt particles, upon reaching the surface, are carried with the overflow liquid over the side of the bucket to the drain.

Oscillator 11 has proved quite efficient in washing a variety of wash loads. An alternative oscillator for use with the washing apparatus 10 is illustrated in FIG. 6 and is designated by the numeral 50. Oscillator 50 includes a power nozzle 51, an interaction region 52, left and right outlet passages 53 and 54, respectively, and left and right control ports 55 and 56, respectively. The oscillator also includes left and right scoop passages 57 and 58, respectively, which feed left and right junctions 59 and 60, respectively, along with left and right air passages 61 and 62, respectively. Flow into junctions 59 and 60 is delivered to left and right feedback passages 63 and 64, respectively which terminate at respective left and right control ports 55 and 56.

The basic difference between oscillator 50 and oscillator 11 is that the former employs a crossover type of interaction region 52 wherein the power stream, when attached to a sidewall, is directed by that sidewall toward the outlet passage on the opposite of the element. Thus, if the power stream is attached to the left sidewall of interaction region 52, it is directed by that sidewall to issue from right outlet passage 54. The importance of this resides in the fact that the feedback passages 63 and 64 do not have to be crossed over the element to connect with opposite control ports. Rather, left feedback passage 63 is connected to left control port 55, and right feedback passage 64 is connected to right control port 56. Elimination of the feedback crossover renders oscillator 50 somewhat simpler to fabricate than oscillator 11. On the other hand, elements with crossover interaction regions have a tendency to be somewhat more lossy and therefore oscillator 50 will tend to have a lower output pressure than oscillator 11 (for the same supply measure and correspondingly-sized elements). Both oscillators operate effectively in washer apparatus 10 and either may be selected for a particular need.

The operation of oscillator 50 is identical to that of oscillator 11 except for the crossover distinction discussed above. Operational description, therefore, need not be repeated for oscillator 50.

Figure 7:
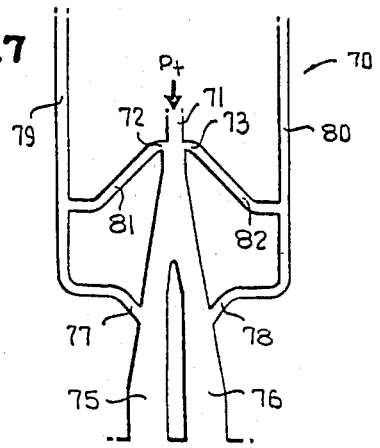
FIG. 7 is a plan view of another alternative oscillator embodiment according to the present invention.

Still another form of oscillator suitable for use with washer apparatus 10 is illustrated in FIG. 7 and designated by the numeral 70. With the exception of the feedback arrangement, oscillator 70 is similar in configuration to oscillator 11. Oscillator 70 thus includes a power nozzle 71, left and right control ports 72 and 73, respectively, interaction region 74, and left and right outlet passages 75 and 76, respectively. In place of scoop passages, oscillator 70 includes left and right suction passages 77 and 78 respectively. Left suction passage 77 communicates with left outlet passage 75 and is oriented to be aspirated by liquid outflow through passage 75. Likewise, right suction passage is oriented to be aspirated by liquid outflow through right outlet passage 76. The other end of left suction passage 77 connects to a generally vertical standpipe or hollow column 79 which extends to above the surface of the liquid in which the oscillator is immersed. A similar standpipe 80 extends from right suction passage 78 to above the liquid surface.

A left feedback passage 81 extends between left standpipe 79 and left control port 72. A right feedback passage 82 extends between right standpipe 80 and right control port 73. The level at which the feedback passages communicate with their respective standpipes must be below the surface of the liquid in which the oscillator is immersed. This fact will be more clearly understood from the following operational description of oscillator 70.

Assume the oscillator to be in its state wherein liquid flows out of left outlet passage 75. Liquid fills right standpipe 80 to the level of liquid in the bucket or tank in which oscillator 70 is immersed. (As previously stated, the tops of the standpipes must extend above the surface). Liquid in the left standpipe 79 is aspirated through suction passage 77 into the outflow through left outlet passage 75 and falls to a level which is below feedback passage 81. (The connections to the feedback passages at the standpipes must be made between these two levels). Under these conditions, the power stream aspirates air through feedback passages 81 to left control port 72 and aspirates water through feedback passage 82 to right control port 73. The greater flow through left control port 81 causes the power stream to switch to right outlet passage 76. In this switched condition the standpipes also reverse states with the level in standpipe 79 rising to the surface level, and the level in standpipe 80 falling to below feedback passage 82. Air now flows through control port 73 at a significantly greater rate than the liquid flow through control port 72. The power stream is thereby caused to switch once again. Oscillation proceeds in this manner at a frequency determined primarily by the time required for the liquid level in the standpipes rise and fall to block and unblock the feedback passages, and by flow delays in the feedback passages.

It should be noted that air is continuously aspirated into the power stream through one or the other of the feedback passages 81 or 82. This air serves as a source for the air bubbles required to effect microflotation (see FIG. 5) when oscillator 70 is employed in washer apparatus 10. In addition, oscillator 70 has the advantage of requiring neither a cross-over interaction region (such as interaction region 52 of FIG. 6) not cross-over feedback passages (such as passages 36 and 37 of FIG. 2).

Figure 8:
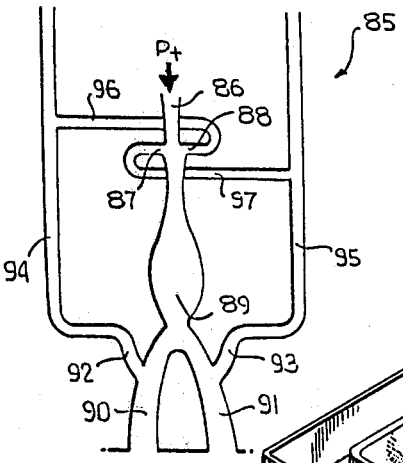
FIG. 8 is a plan view of still another alternative oscillator embodiment according to the present invention.

Still another oscillator suitable for use with washer apparatus 10 is illustrated in FIG. 8 and is designated by the numeral 85. Oscillator 85 also operates on the standpipe principle, utilizing suction passages rather than scoop passages to control feedback. To this end, oscillator 85 includes a power nozzle 86, left and right control ports 87 and 88, respectively, and left and right outlet passages 90 and 91, respectively. Left and right suction passages 92 and 93 communicate between respective outlet passages and respective standpipes 94 and 95.

The distinction between oscillator 85 and oscillator 70 is two fold. First, interaction region 86 of oscillator 85 is of the cross-over type. Second, feedback passages 96 and 97 also cross-over; that is, feedback passage 96 extends between left standpipe 94 and right control port 88, and feedback passage 97 extends between right standpipe 95 and left control port 87. Operation of oscillator 85 is identical to operation of oscillator 70, except for the cross-over arrangements, and is therefore not repeated herein.

Figure 9:
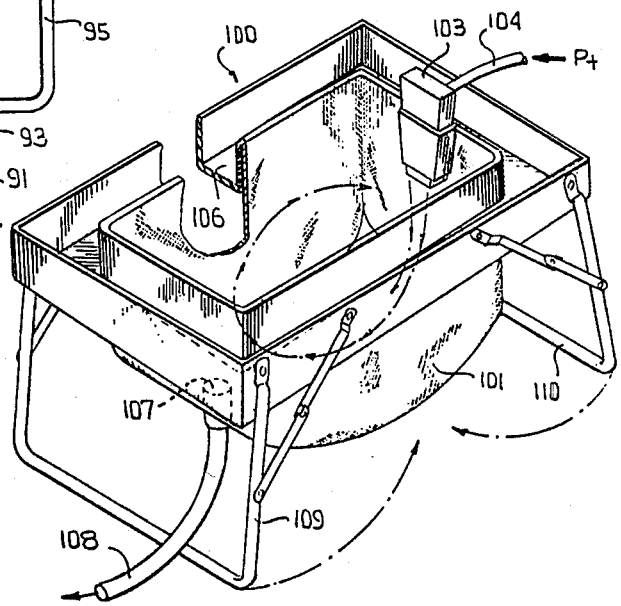
FIG. 9 is a view in perspective of an alternative clothes washer embodiment according to the present invention.

The washer apparatus 10 illustrated in FIG. 1 permits use of any of oscillators 11, 50, 70 and 85 with a conventional bucket, pail, or tank. Alternatively, any source of water pulses may be utilized with the washer. For such apparatus it is possible for the user to simply purchase the oscillator or other pulse source and utilize it with an existing tank or the like. In FIG. 9 there is illustrated a portable washer apparatus 100 in which the entire apparatus is purchased as one assembly and which is readily stored in compact form. Apparatus 100 includes an open collapsible tub 101 made of soft plastic or rubber and of sufficient strength to withstand the pressure exerted therein when the tub is filled with water. Proximate the top of one of the tub sidewalls there is secured a bracket 102 or the like suitable for supporting a fluidic oscillator 103 or other liquid pulse source. This oscillator may be any of oscillators 11, 50, 70 or 85 and, when so supported, is oriented to issue its output pulses downwardly along the tub sidewall. A supply hose 104 is adapted to be connected to any convenient supply of pressurized liquid and conducts same to the power nozzle of the oscillator.

The rim of tub 101 is surrounded by a substantially rigid drain channel 106 having a bottom wall located below the tub rim. The drain channel serves to catch and conduct the liquid overflow from tub 101 and to this end is sloped toward one corner of the tub. At that corner there is provided a drain outlet 107 connected to a drain hose which, in turn, may direct the overflow liquid to a suitable drain.

Folding legs, in the form of a pair of U-shaped bars 109 and 110, are secured to the outer wall of channel 106 by means of locking hinges or the like. When the legs 109, 110 are folded under the tub, tub 101 may be collapsed and be contained within the confines of the drain channel 106. The unit is thus stored in compact form, making it easy to ship and easy for travellers to transport. Operation of apparatus 100 is the same as that of apparatus 10 with the exception that drain channel 106 and localized drain opening 107 and hose 108 avoid the necessity of placing the apparatus in a basin, such as basin 14 of FIG. 1. Instead, hose 108 is simply connected to a suitable drain.

The washer apparatus described herein is extremely efficient in removing dirt from clothes by virtue of the combined effects of tumbling, agitation and microflotation. It has also been found that "pilling", the phenomenon whereby pieces of material tend to form little balls during washing, is not produced in clothes washed according to the present invention.

It should be noted that the washing load, once introduced into the tumbling flow in the bucket or tub, never touches the sides or bottom of the bucket or tub. Instead the clothes merely follow the circulating flow, remote from the walls. This is advantageous because there is no opportunity for the clothes to snag on protruding portions of an apparatus.

An important feature of the washer apparatus is the orientation of the fluidic oscillator or other pulse source to produce flow circulation in a vertical plane rather than in a horizontal plane as is common in prior art fluidic washers. The vertical circulation is what effects the tumbling action of the clothes during the washing operation and is important to efficient dirt removal. Moreover, vertical flow circulation acts to draw the clothes under the surface to be fully wetted, whereas horizontal flow permits the clothes to remain on the surface and be wetted relatively slowly, if at all.

Another important feature of the washer apparatus of the present invention is that the dirt-laden water reaches the surface once during each flow revolution. This, combined with the microflotation of dirt to the surface by the air bubbles (see FIG. 5), assumes that the surface overflow contains substantially all or most of the dirt removed from clothes by the tumbling and agitation actions.

The oscillator frequency is determined by the length of the feedback passages for oscillators 11 and 50 and by the volume of the standpipes in oscillators 70 and 85.

The oscillators as described herein are advantageous in any situation where water pulsation combined with air bubbles is desired at a submerged location. For example, the oscillators described herein may be employed as hand-held or otherwise mounted whirlpool massagers. In such utilization the entire oscillator may be submerged with one or more air hoses extending above the surface to permit ambient air to be aspirated into the oscillator. The bubbles are relatively small as compared to prior art aerating type whirlpool units. The combination of pulsating water with small entrained air bubbles creates a more pleasant feeling upon impacting a bather's body underwater than the steady flow type unit with large bubbles. The small bubbles soften the impact whereas the pulsating action provides a vigorous agitation. The resulting effect is a pleasant tingling massage.

The orientation of the oscillator in the bucket or tub of the washing apparatus should be such that the liquid pulses are issued upwardly or downwardly along a sidewall of the bucket; or horizontally along the bottom of the bucket; or any orientation which results in a tumbling flow circulation in a vertical plane. Angling the oscillator outflow relative to the adjacent bucket wall is less efficient in cleaning a wash load because "dead spots" develop through which no flow occurs. For example, in one test of the apparatus of FIG. 1 the oscillator was gradually pivoted so that the flow was directed more and more toward the center of the bucket. It was noted that the flow circulation gradually skewed and that flow eventually ceased at the far lower corner of the bucket where clothing items might collect.

Bucket 17 and tub 13 can be substantially any size and must be configured to permit re-circulating flow in a vertical plane as described. Thus the sidewall or walls are preferably vertical although they may be tapered slightly; however, any taper must not be so great as to prevent maintenance of the re-circulating flow described.

While we have described and illustrated specific embodiments of our invention, it will be clear that variations of the details of construction which are specifically illustrated and described may be resorted to without departing from the true spirit and scope of the invention as defined in the appended claims.

We claim:

1. A clothes washer comprising:

a container defined by a substantially vertical surface generated about the periphery of the container suitable for containing a predetermined volume of wash liquid, said container having an upper edge permitting overflow from the surface of said volume of liquid upon addition of liquid to said container in excess of said predetermined volume;

pulsing means for delivering wash liquid pulses into said container; and mounting means for securing said pulsing means in a predetermined position relative to said container to deliver said liquid pulses into said container such that the pulses are oriented to induce and maintain a re-circulating liquid flow in a vertical plane in said container and such that the delivery of wash liquid provides overflow from the surface of said volume of wash liquid.

2. The washer according to claim 1 further comprising aerating means for admitting air bubbles into said container at a location substantially below the surface of said predetermined volume of liquid.

3. The washer according to claim 2 wherein said aerating means and said pulsing means are combined in a single means for delivering said liquid pulses intermixed with air.

4. The washer according to claim 3 wherein said single means comprises a fluidic oscillator.

5. The washer according to claim 4 wherein said fluidic oscillator comprises:

two outlet passages;

means for issuing pulses of said wash liquid alternately from said two outlet passages; and means for entraining air into said pulses before issuance from said outlet passages.

6. The washer according to claim 4 wherein said fluidic oscillator comprises:

an interaction region;

a power nozzle adapted to issue a power stream of liquid into the upstream end of said interaction region;

said interaction region having first and second sidewalls, each positioned to effect boundary layer attachment of said power stream, such that said power stream has first and second stable positions in which it is attached to said first and second sidewalls, respectively;

first and second outlet passages at the downstream end of said interaction region, each outlet passage positioned to receive said power stream in a different stable position;

first and second control ports communicating with the upstream end of said interaction region through opposite sidewalls, said control ports being sufficiently proximate said issued power stream to be aspirated thereby, and to deflect said power stream when the pressure differential between said control ports exceeds a predetermined pressure; and oscillation control means responsive to power stream flow through either outlet passage for deflecting said power stream in said interaction and thereby directing said power stream to the other outlet passage, said oscillation control means comprising:

sensing means for sensing which outlet passage is receiving said power stream; and flow control means responsive to sensing which outlet passage is receiving said power stream for flowing air at a relatively high flow rate to one control port and flowing liquid at a relatively low flow rate to the other control port to thereby provide a sufficiently higher pressure at said one control port than at said other control port to deflect said power stream to said other outlet passage.

7. The washer according to claim 6 wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said first outlet passage, and said second sidewall is oriented to direct said power stream when attached thereto to said second outlet passage;

wherein said sensing means comprises a first scoop passage positioned to receive a portion of the power stream flowing in said first outlet passage, and a second scoop passage positioned to receive a portion of the power stream flowing in said second outlet passage; and wherein said flow control means comprises:

first and second feedback passages;

first and second air passages;

said first feedback passage being arranged to deliver liquid received by said first scoop passage to said second control port;

said second feedback passage being arranged to deliver liquid received by said second scoop passage to said first control port;

said first air passage being arranged to supply ambient air to said first feedback passage; and said second air passage being arranged to supply ambient air to said second feedback passage.

8. The washer according to claim 6 wherein said interaction region is configured as a flow reversing chamber, wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said second outlet passage, and said second sidewall is oriented to direct said power stream when attached thereto to said first outlet passage;

wherein said sensing means comprises a first scoop passage positioned to receive a portion of the power stream flowing in said first outlet passage, and a second scoop passage positioned to receive a portion of the power stream flowing in said second outlet passage; and wherein said flow control means comprises:

first and second feedback passages;

first and second air passages;

said first feedback passage being arranged to deliver liquid received by said first scoop passage to said first control port;

said second feedback passage being arranged to deliver liquid received by said second scoop passage to said second control port;

said first air passage being arranged to supply ambient air to said first feedback passage in the absence of power stream liquid in said first feedback passage;

said second air passage being arranged to supply ambient air to said second feedback passage in the absence of power stream liquid in said second feedback passage.

9. The washer according to claim 6 wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said first outlet passage, and said second sidewall is oriented to direct said power stream when attached thereto to said second outlet passage;

wherein said sensing means comprises a first suction passage positioned to be aspirated by power stream flow through said first outlet passage, and a second suction passage positioned to be aspirated by power stream flow through said second outlet passage; and wherein said flow control means comprises:

first and second open-ended standpipes arranged to extend vertically to above the surface of said body of liquid and connected at their lower ends to said first and second suction passages, respectively, such that the liquid level in said first standpipe rises to the surface of said body of liquid in the absence of power stream flow through said first outlet passage and is aspirated to some lower level by power stream flow through said first outlet passage, and such that the liquid level in said second standpipe rises to the surface of said body of liquid in the absence of power stream flow through said second outlet passage and is aspirated some lower level by power stream flow through said second outlet passage;

a first control passage connected from said first control port to a connection at said first standpipe between said surface level and lower level to permit air flow to said first control port when the liquid in said first standpipe is below said connection and to permit only water flow to said first control port when the liquid level in said first standpipe is above said connection; and a second control passage connected from said second control port to a connection at said second standpipe between said surface level and lower level to permit air flow to said first control port when the liquid in said second standpipe is below said connection and to permit only water flow to said first control port when the liquid in said second standpipe is above said connection.

10. The washer according to claim 6 wherein said interaction region is configured as a flow reversing chamber, wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said second outlet passage, and said second sidewall is oriented to direct said power stream when attached thereto to said first outlet passage;

wherein said sensing means comprises a first suction passage positioned to be aspirated by power stream flow through said first outlet passage, and a second suction passage positioned to be aspirated by power stream flow through said second outlet passage; and wherein said flow control means comprises:

first and second open-ended standpipes arranged to extend vertically to above the surface of said body of liquid and connected at their lower ends to said first and second suction passages, respectively, such that the liquid level in said first standpipe rises to the surface of said body of liquid in the absence of power stream flow through said first outlet passage and is aspirated to some lower level by power stream flow through said first outlet passage, and such that the liquid level in said second standpipe rises to the surface of said body of liquid in the absence of power stream flow through said second outlet passage and is aspirated to some lower level by power stream flow through said second outlet passage;

a first control passage connected from said second control port to a connection at said first standpipe between said surface level and lower level to permit air flow to said second control port when the liquid in said first standpipe is below said connection and to permit only water flow to said second control port when the liquid level in said first standpipe is above said connection; and a second control passage connected from said first control port to a connection at said second standpipe between said surface level and lower level to permit air flow to said second control port when the liquid in said second standpipe is below said connection and to permit only water flow to said second control port when the liquid in said second standpipe is above said connection.

11. The washer according to claim 1 wherein said mounting means is arranged to position said pulsing means such that clothes carried by said recirculating flow are impinged upon by liquid pulses being issued from said pulsing means.

12. The washer according to claim 11 wherein said substantially vertical surface includes at least one substantially vertical sidewall, and wherein said mounting means comprises means for securing said pulsing means at least partially submerged in said predetermined volume of liquid and relative to said one sidewall such that said liquid pulses are issued generally along said one sidewall from a location below the surface of said predetermined volume of liquid.

13. The washer according to claim 12 further comprising means for introducing air bubbles into said container below the surface of said predetermined volume of liquid.

14. The washer according to claim 12 wherein said pulsing means comprises a fluidic oscillator of the type in which a power stream of said wash liquid is oscillatorily deflected between two outlet passages to provide said liquid pulses in alternation from said two outlet passages, said oscillator including air passage means for continuously entraining ambient air into said power stream in sufficient quantity to form air bubbles below the surface of said volume of liquid when the entrained air is issued into said container with said power stream.

15. The washer according to claim 14 arranged as a portable unit, wherein said container comprises at least in part a soft flexible water-impervious material, said washer further comprising support means for standing said container with said soft flexible material freely suspended.

16. The washer according to claim 15 wherein said support means comprises collapsible legs secured to said container.

17. The washer according to claim 15 further comprising a drain channel surrounding said container and positioned to receive overflow from said container, said drain channel having a drain outlet defined therein for draining liquid from said drain channel.

18. The washer according to claim 12 wherein said pulsing means is a fluidic oscillator comprising:

an interaction region;

a power nozzle adapted to issue a power stream of liquid into the upstream end of said interaction region;

said interaction region having first and second sidewalls, each positioned to effect boundary layer attachment of said power stream, such that said power stream has first and second stable positions in which it is attached to said first and second sidewalls, respectively;

first and second outlet passages at the downstream end of said interaction region, each outlet passage positioned to receive said power stream in a different stable position;

first and second control ports communicating with the upstream end of said interaction region through opposite sidewalls, said control ports being sufficiently proximate said issued power stream to be aspirated thereby, and to deflect said power stream when the pressure differential between said control ports exceeds a predetermined pressure;

oscillation control means responsive to power stream flow through either outlet passage for deflecting said power stream in said interaction and thereby directing said power stream to the other outlet passage, said oscillation control means comprising:

sensing means for sensing which outlet passage is receiving said power stream;

flow control means responsive to sensing which outlet passage is receiving said power stream for flowing air at a relatively high flow rate to one control port and flowing liquid at a relatively low flow rate to the other control port to thereby provide a sufficiently higher pressure at said one control port than at said other control port to deflect said power stream to said other outlet passage.

19. The washer according to claim 18 wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said first outlet passage, and said second sidewall is oriented to direct said power stream when attached thereto to said second outlet passage;

wherein said sensing means comprises a first scoop passage positioned to receive a portion of the power stream flowing in said first outlet passage, and a second scoop passage positioned to receive a portion of the power stream flowing in said second outlet passage; and wherein said flow control means comprises:

first and second feedback passages;

first and second air passages;

said first feedback passage being arranged to deliver liquid received by said first scoop passage to said second control port;

said second feedback passage being arranged to deliver liquid received by said second scoop passage to said first control port;

said first air passage being arranged to supply ambient air to said first feedback passage; and said second air passage being arranged to supply ambient air to said second feedback passage.

20. The washer according to claim 18 wherein said interaction region is configured as a flow reversing chamber, wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said second outlet passage, and said second sidewall is oriented to direct said power stream when attached thereto to said first outlet passage;

wherein said sensing means comprises a first scoop passage positioned to receive a portion of the power stream flowing in said first outlet passage, and a second scoop passage positioned to receive a portion of the power stream flowing in said second outlet passage; and wherein said flow control means comprises:

first and second feedback passages;

first and second air passages;

said first feedback passage being arranged to deliver liquid received by said first scoop passage to said first control port;

said second feedback passage being arranged to deliver liquid received by said second scoop passage to said second control port;

said first air passage being arranged to supply ambient air to said first feedback passage in the absence of power stream liquid in said first feedback passage;

said second air passage being arranged to supply ambient air to said second feedback passage in the absence of power stream liquid in said second feedback passage.

21. The washer according to claim 18 wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said first outlet passage, and said second sidewall is oriented to direct said power stream when attached thereto to said second outlet passage;

wherein said sensing means comprises a first suction passage positioned to be aspirated by power stream flow through said first outlet passage, and a second suction passage positioned to be aspirated by power stream flow through said second outlet passage; and wherein said flow control means comprises:

first and second open-ended standpipes arranged to extend vertically to above the surface of said body of liquid and connected at their lower ends to said first and second suction passages, respectively, such that the liquid level in said first standpipe rises to the surface of said body of liquid in the absence of power stream flow through said first outlet passage and is aspirated to some lower level by power stream flow through said first outlet passage, and such that the liquid level in said second standpipe rises to the surface of said body of liquid in the absence of power stream flow through said second outlet passage and is aspirated some lower level by power stream flow through said second outlet passage;

a first control passage connected from said first control port to a connection at said first standpipe between said surface level and lower level to permit air flow to said first control port when the liquid in said first standpipe is below said connection and to permit only water flow to said first control port when the liquid level in said first standpipe is above said connection; and a second control passage connected from said second control port to a connection at said second standpipe between said surface level and lower level to permit air flow to said first control port when the liquid in said second standpipe is below said connection and to permit only water flow to said first control port when the liquid in said second standpipe is above said connection.

22. The washer according to claim 1 wherein said pulsing means is a fluidic oscillator comprising:

an interaction region;

a power nozzle adapted to issue a power stream of liquid into the upstream end of said interaction region;

said interaction region having first and second sidewalls, each positioned to effect boundary layer attachment of said power stream, such that said power stream has first and second stable positions in which it is attached to said first and second sidewalls, respectively;

first and second outlet passages at the downstream end of said interaction region, each outlet passage positioned to receive said power stream in a different stable position;

first and second control ports communicating with the upstream end of said interaction region through opposite sidewalls, said control ports being sufficiently proximate said issued power stream to be aspirated thereby, and to deflect said power stream when the pressure differential between said control ports exceeds a predetermined pressure;

oscillation control means responsive to power stream flow through either outlet passage for deflecting said power stream in said interaction and thereby directing said power stream to the other outlet passage, said oscillation control means comprising:
sensing means for sensing which outlet passage is receiving said power stream;
flow control means responsive to sensing which outlet passage is receiving said power stream for flowing air at a relatively high flow rate to one control port and flowing liquid at a relatively low flow rate to the other control port to thereby provide a sufficiently higher pressure at said one control port than at said other control port to deflect said power stream to said other outlet passage.

23. The washer according to claim 22 wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said first outlet passage, and said second sidewall is oriented to direct said power stream when attached thereto to said second outlet passage;
wherein said sensing means comprises a first scoop passage positioned to receive a portion of the power stream flowing in said first outlet passage, and a second scoop passage positioned to receive a portion of the power stream flowing in said second outlet passage; and
wherein said flow control means comprises:
first and second feedback passages;
first and second air passages;
said first feedback passage being arranged to deliver liquid received by said first scoop passage to said second control port;
said second feedback passage being arranged to deliver liquid received by said second scoop passage to said first control port;
said first air passage being arranged to supply ambient air to said first feedback passage; and
said second air passage being arranged to supply ambient air to said second feedback passage.

24. The washer according to claim 22 wherein said interaction region is configured as a flow reversing chamber, wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said second outlet passage, and said second sidewall is oriented to direct said power stream when attached thereto to said first outlet passage;
wherein said sensing means comprises a first scoop passage positioned to receive a portion of the power stream flowing in said first outlet passage, and a second scoop passage positioned to receive a portion of the power stream flowing in said second outlet passage; and
wherein said flow control means comprises:
first and second feedback passages;
first and second air passages;
said first feedback passage being arranged to deliver liquid received by said first scoop passage to said first control port;
said second feedback passage being arranged to deliver liquid received by said second scoop passage to said second control port;
said first air passage being arranged to supply ambient air to said first feedback passage in the absence of power stream liquid in said first feedback passage;
said second air passage being arranged to supply ambient air to said second feedback passage in the absence of power stream liquid in said second feedback passage.

25. The washer according to claim 22 wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said first outlet passage, and said second sidewall is oriented to direct said power stream when attached thereto to said second outlet passage;
wherein said sensing means comprises a first suction passage positioned to be aspirated by power stream flow through said first outlet passage, and a second suction passage positioned to be aspirated by power stream flow through said second outlet passage; and
wherein said flow control means comprises:
first and second open-ended standpipes arranged to extend vertically to above the surface of said body of liquid and connected at their lower ends to said first and second suction passages, respectively, such that the liquid level in said first standpipe rises to the surface of said body of liquid in the absence of power stream flow through said first outlet passage and is aspirated to some lower level by power stream flow through said first outlet passage, and such that the liquid level in said second standpipe rises to the surface of said body of liquid in the absence of power stream flow through said second outlet passage and is aspirated some lower level by power stream flow through said second outlet passage;
a first control passage connected from said first control port to a connection at said first standpipe between said surface level and lower level to permit air flow to said first control port when the liquid in said first standpipe is below said connection and to permit only water flow to said first control port when the liquid level in said first standpipe is above said connection; and
a second control passage connected from said second control port to a connection at said second standpipe between said surface level and lower level to permit air flow to said first control port when the liquid in said second standpipe is below said connection and to permit only water flow to said first control port when the liquid in said second standpipe is above said connection.

26. The washer according to claim 22 wherein said interaction region is configured as a flow reversing chamber, wherein said first control port, said first interaction region sidewall, and said first outlet passage are disposed on one side of said oscillator; wherein said second control port, said second interaction region sidewall, and said second outlet passage are disposed on the opposite side of said oscillator; and wherein said first sidewall is oriented to direct said power stream when attached thereto to said second outlet passage, and said second sidewall is oriented to direct said power stream when attached thereto to said first outlet passage;

wherein said sensing means comprises a first suction passage positioned to be aspirated by power stream flow through said first outlet passage, and a second suction passage positioned to be aspirated by power stream flow through said second outlet passage; and wherein said flow control means comprises:

first and second open-ended standpipes arranged to extend vertically to above the surface of said body of liquid and connected at their lower ends to said first and second suction passages, respectively, such that the liquid level in said first standpipe rises to the surface of said body of liquid in the absence of power stream flow through said first outlet passage and is aspirated to some lower level by power stream flow through said first outlet passage, and such that the liquid level in said second standpipe rises to the surface of said body of liquid in the absence of power stream flow through said second outlet passage and is aspirated to some lower level by power stream flow through said second outlet passage;

a first control passage connected from said second control port to a connection at said first standpipe between said surface level and lower level to permit air flow to said second control port when the liquid in said first standpipe is below said connection and to permit only water flow to said second control port when the liquid level in said first standpipe is above said connection; and a second control passage connected from said first control port to a connection at said second standpipe between said surface level and lower level to permit air flow to said second control port when the liquid in said second standpipe is below said connection and to permit only water flow to said second control port when the liquid in said second standpipe is above said connection.

* * * * *